United States Patent [19]

Naquin

[11] Patent Number: 4,807,873

[45] Date of Patent: Feb. 28, 1989

[54] ABDOMINAL EXERCISE APPARATUS AND METHOD

[76] Inventor: Charles E. Naquin, 1604 Chatham Ave., Austin, Tex. 78723

[21] Appl. No.: 98,368

[22] Filed: Sep. 18, 1987

[51] Int. Cl.[4] ..... A63B 23/00

[52] U.S. Cl. ..... 272/93; 272/117

[58] Field of Search ..... 272/93, 117, 116, 900, 272/122, 143, 63, 62; 248/163.1, 172, 440.1, 149

[56] References Cited

U.S. PATENT DOCUMENTS

| | | | |
|---|---|---|---|
| 925,849 | 6/1909 | STahl | 248/172 |
| 2,617,650 | 11/1952 | Landis | 272/122 |
| 3,414,261 | 12/1968 | Huebner | 272/117 |
| 3,430,953 | 3/1969 | Teetor | 272/900 X |
| 3,787,048 | 1/1974 | Bock | 272/145 |
| 3,904,196 | 9/1975 | Berlin | 272/72 |
| 4,344,619 | 8/1982 | Szabo | 272/117 |
| 4,591,150 | 5/1986 | Mosher | 272/900 X |
| 4,691,919 | 9/1987 | Roberson | 272/145 |

*Primary Examiner*—Richard J. Apley
*Assistant Examiner*—Franklin L. Gubernick
*Attorney, Agent, or Firm*—Roylance, Abrams, Berdo & Goodman

[57] ABSTRACT

An abdominal exercise apparatus includes a first cross bar positioned behind the user's ankles, a second cross bar positioned above and over the user's knees and a third cross bar positioned below the user's hips and behind the user's thighs. A rigid frame connects the centers of the three cross bars and maintains the cross bars in parallel. The first cross bar can be adapted to support weights. With the user on the user's back, the apparatus is held with the user's legs. The user raises and lowers the user's legs with the apparatus to exercise abdominal muscles.

15 Claims, 2 Drawing Sheets

ABDOMINAL EXERCISE APPARATUS AND METHOD

FIELD OF THE INVENTION

The present invention relates to an exercise apparatus and method of exercising for efficiently and effectively developing abdominal muscles. The apparatus is a barbell which can be held by the user's legs. Raising and lowering of the legs isolates and exercises the user's abdominal muscles.

BACKGROUND OF THE INVENTION

Numerous exercises have been used for developing abdominal muscles. Such exercises include sit ups, leg raises, rollovers, leg press-outs and others. Since these exercises are normally performed without any apparatus, adequate resistance is not provided. Additionally, these exercises place strain on other muscles, in addition to the abdominal muscles, such that the abdominal muscles are not effectively isolated.

Conventional exercises present numerous problems For example, in leg lifts, stress is exerted on the leg muscles as well as the abdominal muscles. Since leg muscles often tire before the abdominal muscles, development of the abdominal muscles is limited. Also these exercises require increasing the repetitions since the resistance cannot be effectively increased. This increases the amount of time necessary for performing adequate exercise. Further, the conventional exercises, in stressing the back muscles, can lead to permanent damage of the back muscles.

Additionally, sophisticated machines have been developed as abdominal exercise apparatus. However, these apparatus have tended to be complex to use and expensive.

SUMMARY OF THE INVENTION

An object of the present invention is to provide an apparatus and method for exercising abdominal muscles which effectively isolates the abdominal muscles during exercising, provides adequate resistance for an efficient and effective development of the abdominal muscles, and has a relatively high degree of safety.

Another object of the present invention is to provide an efficient and effective apparatus for developing abdominal muscles which is simple and inexpensive to manufacture, and easy to use.

A further object of the present invention to provide an abdominal exercise apparatus which is of rugged construction.

The foregoing objects are obtained by an abdominal exercise apparatus comprising first, second and third cross bars, and a rigid frame connecting the cross bars. The cross bars are parallel. The first cross bar is positioned behind the user's ankles. The second cross bar is positioned above and over the user's knees. The third cross bar is positioned below the user's hips and behind the user's thighs.

The foregoing objects are also obtained by an exercise apparatus comprising first, second and third cross bars oriented parallel to each other. Longitudinal centers of the cross bars define corners of a triangle. A rigid frame connects the cross bars, extends perpendicular to the cross bars and connects the cross bars at their longitudinal centers.

The foregoing objects are additionally obtained by a method of exercising abdominal muscles comprising the steps of a user lying on a horizontal surface with the user's back against the horizontal surface, and wrapping the user's legs about an abdominal exercise apparatus having first, second and third parallel cross bars and the rigid frame connected to the cross bars, such that the first cross bar is positioned behind the user's ankles, the second cross bar is positioned above and over the user's knees and the third cross bar is positioned below the user's hips and behind the user's thighs. The user then raises and lowers the user's legs and the apparatus through an arc centered generally in the user's hips.

By forming the apparatus and performing the method in this matter, the abdominal muscles are effectively isolated and are subjected to an effective amount of resistance. Additionally, the device is extremely safe.

The weight of the apparatus, including any weights added to the first cross bar, is transferred through the frame to the second and third cross bars. Due to the positioning of the third cross bar below the user's hips, the third cross bar does not exert a force on the user such that no lifting torque is exerted at that point. The entire lifting torque is exerted at the second cross bar above the user's knees. By lifting the legs with a resistance above and over the user's knees, the force is isolated against the abdominal muscles for more effective and efficient exercise. With the user's legs being bent, and the user's back fully supported on the ground or other flat, horizontal surface, the device safely prevents injury to the back.

Further, by arrangement of the apparatus in this manner, weights can be added to the first cross bar to increase the weight of the apparatus as the user's abdominal muscles are developed. This permits increased development by increasing weight in lieu of increasing repetitions.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form part of this disclosure.

DETAILED DESCRIPTION OF PREFERRED EMBODIMENT OF THE INVENTION

Figure 1:
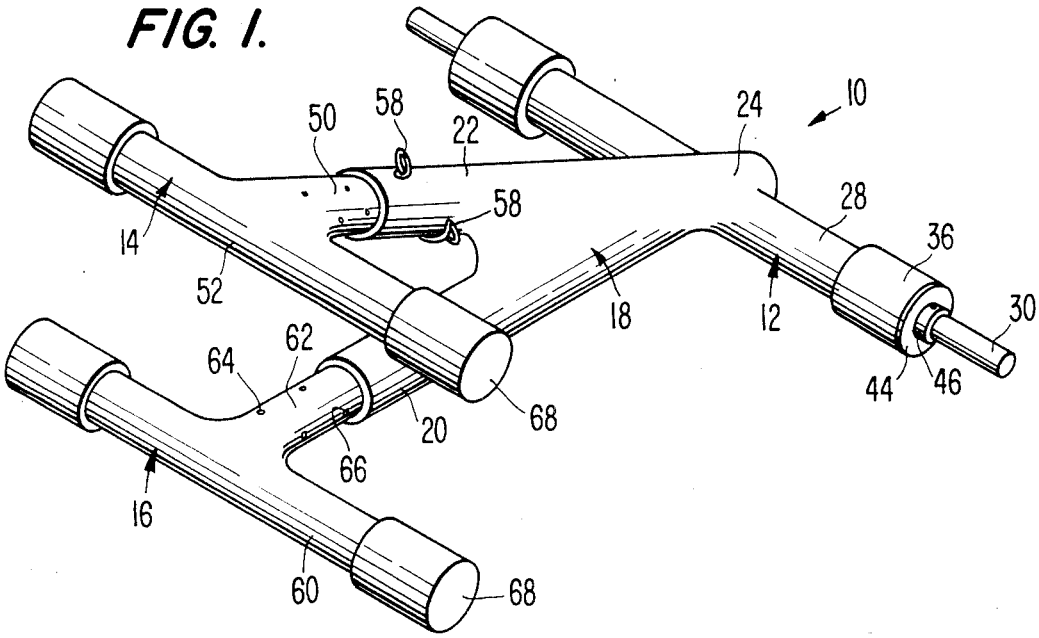
FIG. 1 is a perspective view of an abdominal exercise device according to the present invention.
Figure 2:
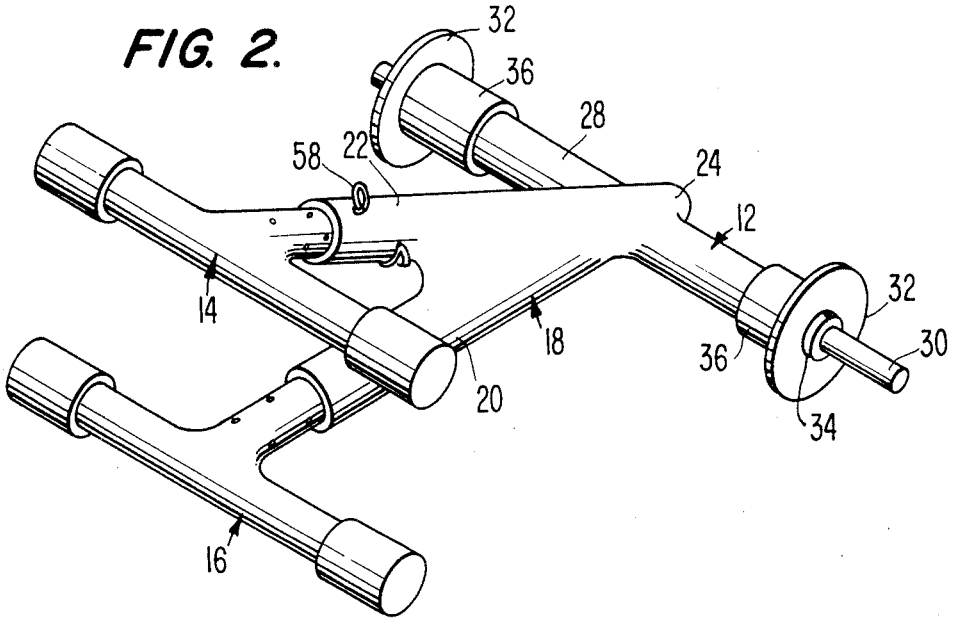
FIG. 2 is a perspective view of the abdominal exercise apparatus of FIG. 1 with weights added to the first cross bar.
Figure 3:
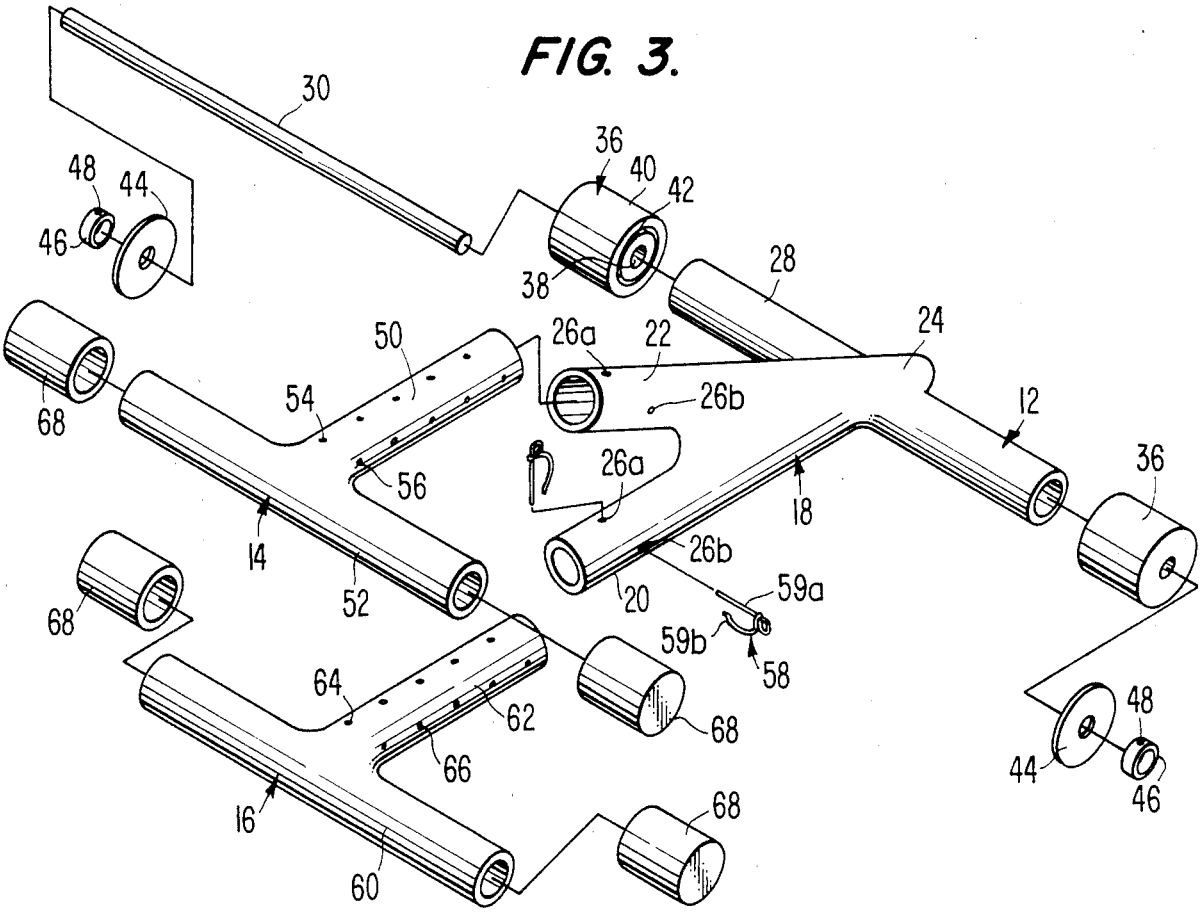
FIG. 3 is an exploded, perspective view of the abdominal exercise apparatus of FIG. 1.

Referring initially to FIGS. 1–3, the abdominal exercise apparatus 10 of the present invention comprises a first cross bar 12, a second cross bar 14 and a third cross bar 16 rigidly connected by a frame 18. The cross bars are parallel to each other. The frame is connected to the longitudinal center of each cross bar and extends generally in a single plane perpendicular to the longitudinal axes of the cross bars.

Frame 18 is a rigid V-shaped member having two acutely angled legs 20 and 22. The legs are oriented at an acute angle of about 45° to each other and are joined at an apex 24. The legs are defined by hollow tubular members, and have pairs of diametrically opposed vertical apertures 26*a* and horizontal apertures 26*b* extending transversely through the tubular walls of the legs.

First cross bar 12 extends transversely relative to frame 18 and is connected to the frame at apex 24. The first leg comprises a hollow tubular member 28 and a rigid support rod 30 extending coaxially through tubular member 28. Since the support rod has an axial length greater than tubular member 28, the opposite longitudinal ends of support rod 30 extend axially beyond tubular member 28 as illustrated in FIGS. 1 and 2. This axial extension of the support rod facilitates the mounting of conventional weights 32. Weights 32 are of the type used with conventional barbell devices presently on the market. The weights are secured in place by conventional locking rings 34.

Figure 5:
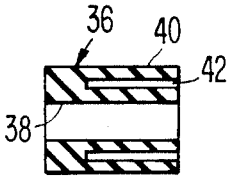
FIG. 5 is a side elevational view in section of an end member for the first cross bar.

Support rod 30 is coaxially mounted and retained within tubular member 28 by end members 36. As illustrated in FIGS. 3 and 5, each end member 36 has a generally cylindrical peripheral configuration and a coaxial through bore 38. Between its outer periphery 40 and bore 38, each end member has an annular recess 42 which opens on one axial end of the end member, but terminates short of the opposite axial end.

In assembling the apparatus, end members 36 are mounted on the opposite axial ends of tubular member 28 such that the tubular member axial ends are received within recesses 42 of end members 36. This locates bore 38 coaxial to the longitudinal axis of tubular member 28 and of cross bar 12. The support rod is then secured against axial movement relative to tubular member 28 by washers 44 and lock rings 46. Lock rings 46 include set screws 48 which threadedly engage and pass radially through the lock rings and which tightly engage the support bar to retain the support rod in place.

The end members can be made of elastimeric material. The resiliency of this elastimeric material will avoid injury to the user and increase the comfort of the user.

Second cross bar 14 and third cross bar 16 are identical T-shaped members. Thus, only one will be described in detail.

Cross member 14 comprises a tubular shank member 50 and a tubular cross member 52 which are rigidly connected. Shank member 50 is telescopically received within tubular leg 20 of frame 18. By sliding shank 50 in and out of leg 22, the spacing between first cross bar 12 and second cross bar 14 can be adjusted, adapting the apparatus to the size of the user.

The shank 50 has a plurality of pairs of horizontally aligned apertures 54 and vertically aligned apertures 56. The apertures of each pair are diametrically opposite each other in the wall of tubular shank 50. Each pair of opposite apertures in shank 50 is alignable with the corresponding apertures 26*a* or 26*b* in tubular leg 22 of frame 18. With the respective apertures aligned and cross member 52 located in the desired position, resilient locking pins 58 are located in the respective horizontal and vertical sets of aligned apertures to retain cross member 52 in the desired position relative to first cross bar 12. Pins 58 have straight legs 59*a* which extend through the apertures in the frame leg and shank, and resilient curved legs 59*b* which extend around portions of frame leg 22 to retain the pins in the apertures.

In a similar manner, cross bar 16 has a cross member 60 and a shank 62 with vertical apertures 64 and horizontal apertures 66. The shank and apertures of cross bar 16 cooperate with the frame leg 20 and the apertures 26*a* and 26*b* in frame leg 20 and with locking pins 58 in the same manner discussed above. Cross bar 16 is adjustable in the same manner as cross bar 14 to vary the spacing between the three cross bars.

Figure 4:
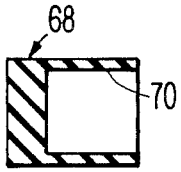
FIG. 4 is a side elevational view in section of an end cap for the second and third cross bars of FIG. 3.

The opposite longitudinal ends of cross bars 14 and 16 are provided with end caps 68. Each end cap 68 is generally cylindrical and includes a blind bore 70 opening on one of its axial ends (see FIG. 4). Each blind bore 70 receives and frictionally engages an end of the second or third cross bars. The end caps are preferably formed of elastimeric material to provide a cushion.

Figure 6:
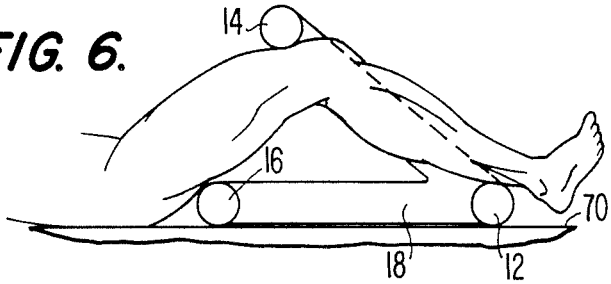
FIGS. 6–8 are side elevational views schematically illustrating the sequential steps of using the abdominal exercise apparatus of FIG. 1.
Figure 7:
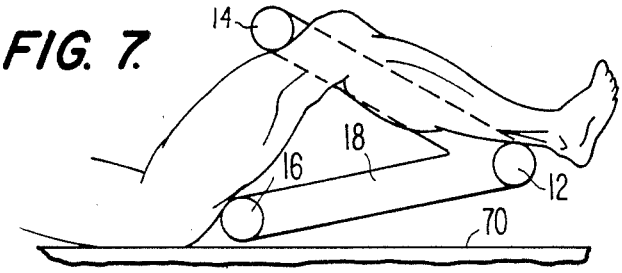
Figure 8:
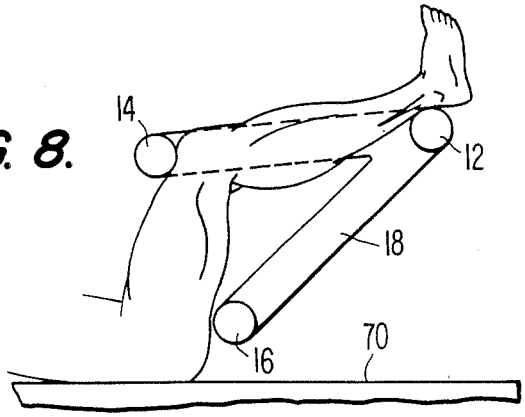

As illustrated in FIGS. 1 and 2, as well as FIGS. 6–8, the longitudinal centers of the cross bars define the corners of an obtuse scalene triangle. The center of first cross bar 12 and the center of third cross bar 16 define the longest length side of the triangle. The centers of second cross bar 14 and third cross bar 16 define the smallest length side, while the centers of first cross bar 12 and second cross bar 14 define the intermediate length side of the triangle.

Typically, cross members 52 and 60 are each about 20 inches in length and about 2 inches in diameter, with a wall thickness of about ½ inch. Shanks 50 and 62 terminate at that free end at a distance of about 12 inches from the center line or longitudinal axis of the respective cross member and have a longitudinal axis extending through the longitudinal center of the respective cross member. The transverse dimensions of the shanks are the same as the cross members.

For frame 18, tubular member 28 has an axial length of about 20 inches. Each leg 20 or 22 extends from the center line or longitudinal axis of tubular member 28 to its free end over a distance of about 17 inches.

The method of using the abdominal exercise apparatus of the present invention is graphically illustrated in FIGS. 6–8. Initially, the user lies on a horizontal surface 70. The user's back and first cross bar 12 and third cross bar 16 of apparatus 10 lie against or at least adjacent to horizontal surface 70. First cross bar 12 is positioned behind the user's ankles as the ankles rest on the first cross bar 12. Second cross bar 14 is positioned above and over the user's knees. Third cross bar 16 is positioned below the user's hips and behind the user's thighs. The user's knees are slightly flexed.

From the rest position in FIG. 6, the user's legs are raised upwardly in an arc centered generally on the user's hips. The force created by the weight of the apparatus, including any weights placed on the ends of first cross bar 12, is placed by second cross bar 14 above and over the user's knees. Lifting the apparatus as illustrated in FIGS. 7 and 8 applies stress to the user's abdominal muscles, which are effectively isolated in this exercise. From the position illustrated in FIG. 8, the user's legs and the apparatus are lowered through the position illustrated in FIG. 7 back to the rest position illustrated in FIG. 6. The exercise is then repeated for the desired number of repetitions.

With the knees slightly being bent, the back muscles and the leg muscles are relaxed during the exercise to concentrate development on the abdominal muscles. By locating the frame between the user's legs and by holding the frame between the legs, the apparatus is stabilized against twisting.

While a particular embodiment has been chosen to illustrate the invention, it will be understood by those skilled in the art that various changes and modifications can be made therein without departing from the scope of the invention as defined in the appended claims. For example, the frame can take other configurations, as long as the frame is simple, is rigid and maintains the cross bars in their desired spaced and parallel arrangement during exercise.

What is claimed is:

1. An abdominal exercise apparatus, comprising:

a first cross bar means for positioning behind a user's ankles;

a second cross bar means for positioning above and over the user's knees;

a third cross bar means for positioning below the user's hips and behind the user's thighs; and a rigid frame connecting said first, second and third cross bar means, said first, second and third cross bar means being parallel to each other, said frame generally extending in a single plane perpendicular to said cross bar means and having a generally V-shaped member with two acutely angled legs and an apex between said legs, said first cross bar means being connected to sais apex and said second and third cross bar means being connected to free ends of said legs and whereby said first, second and third cross bar means are connected at their longitudinal centers to said V-shaped member.

2. An abdominal exercise apparatus according to claim 1 wherein said legs comprise selectively adjustable telescoping members with locking means for permitting adjustment of distances between said cross bar means.

3. An abdominal exercise apparatus according to claim 1 wherein said first cross bar means comprises means for supporting weights at opposite longitudinal ends thereof.

4. An abdominal exercise apparatus according to claim 1 wherein centers of said cross bar means define corners of an obtuse scalene triangle, with said centers of said first and third cross bar means defining a longest side of said triangle.

5. An abdominal exercise apparatus according to claim 1 wherein said cross bar means are hollow tubes.

6. An abdominal exercise apparatus according to claim 1 wherein said first cross bar means is hollow and comprises a support rod extending coaxially therethrough and beyond, longitudinal ends of said support rod having means for supporting weights thereon.

7. An exercise apparatus, comprising:

first, second and third cross bars oriented generally parallel to each other and having longitudinal centers defining corners of a triangle;

a rigid frame connecting said first, second and third cross bars, said frame extending perpendicular to said cross bars and connected to said cross bars at said longitudinal centers, said frame including a generally V-shaped member with two acutely angled legs with an apex between said legs, said first cross bar being connected to said apex and said second and third cross bars being connected to free ends of said legs.

8. An exercise apparatus according to claim 7 wherein said legs comprise selectively lockable telescoping members with locking means for permitting adjustment of distances between said cross bars.

9. An exercise apparatus according to claim 7 wherein said first cross bar comprises means for supporting weights at opposite longitudinal ends thereof.

10. An exercise apparatus according to claim 7 wherein said triangle is an obtuse scalene triangle.

11. An exercise apparatus according to claim 7 wherein said cross bars are hollow tubes.

12. An exercise apparatus according to claim 10 wherein said first cross bar means is hollow and comprises support rod extending coaxially therethrough and beyond, longitudinal ends of said support rod having means for supporting weights thereon.

13. A method of exercising abdominal muscles, comprising the steps of:

a user lying on a horizontal surface with the user's back against the horizontal surface;

wrapping the user's legs about an abdominal exercise apparatus having first, second and third parallel cross bars and a rigid frame connected to the cross bars, such that the first cross bar is positioned behind the user's ankles, the second cross bar is positioned above and over the user's knees, and the third cross bar is positioned below the user's hips and behind the user's thighs; and raising and lowering the user's legs and the apparatus through an arc centered generally in the user's hips.

14. A method according to claim 13 wherein the user's knees are slightly bent.

15. A method according to claim 13 wherein the frame is located and held between the user's legs.

* * * * *